United States Patent [19]

Teafatiller

[11] Patent Number: 4,982,966

[45] Date of Patent: Jan. 8, 1991

[54] RING TOSS GAME APPARATUS

[76] Inventor: William J. Teafatiller, 11315 N.W. 36th Ave., Vancouver, Wash. 98685

[21] Appl. No.: 381,462

[22] Filed: Jul. 18, 1989

[51] Int. Cl.[5] ..... A63B 67/06

[52] U.S. Cl. ..... 273/338; 273/336; 273/400

[58] Field of Search ..... 273/336, 338, 398, 400, 273/401, 402, 424, 425

[56] References Cited

U.S. PATENT DOCUMENTS

| | | | |
|---|---|---|---|
| 2,050,914 | 8/1936 | Anderson | 273/401 |
| 2,126,245 | 8/1938 | Darby | 273/425 |
| 2,147,502 | 2/1939 | Savage | 273/424 |
| 3,815,915 | 6/1974 | Chapman | 273/338 |
| 4,204,682 | 5/1980 | Brown | 273/401 |
| 4,392,653 | 7/1983 | Blume, Sr. | 273/400 |
| 4,687,210 | 7/1987 | Michel | 273/425 |
| 4,877,256 | 10/1984 | Falloon | 273/400 |

*Primary Examiner*—William H. Grieb

*Attorney, Agent, or Firm*—Leon Gilden

[57] ABSTRACT

A ring toss game apparatus is set forth wherein a plurality of aligned and securable cases are provided, each containing arcuate, diametrically opposed slots of finite length cooperative with arcuate projections directed coaxially from a bottom edge of a cylinder receivable within each pair of arcuate slots. Planar ring washers are thrown to be received within the cylinder or with each case. Peg-like members are optionally positionable interiorly of each cylinder for enhanced scoring. The final position of each ring washer relative to the interior of the cylinder and/or peg determines point scoring withing the game.

5 Claims, 4 Drawing Sheets

RING TOSS GAME APPARATUS

BACKGROUND OF THE INVENTION

1. Field of the Invention

The field of invention relates to games, and more particularly pertains to a new and improved ring toss game wherein the object of the game is to direct a series of ring washers interiorly of a cylinder and optionally about pegs positioned within the cylinder.

2. Description of the Prior Art

Toss games of various types are well known in the prior art. The toss games of the prior art have utilized various throwing disks and targets as objects of the tossing procedure. For example, U.S. Pat. No. 2,050,914 to Anderson sets forth a game board wherein a positioned cup provides a target for articles projected onto the game board.

U.S. Pat. No. 2,126,245 to Darby sets forth a toss game wherein buoyancy disks are directed at a receptacle, wherein the receptacle is of a cylindrical configuration formed as a flexible basket supported about a framework.

U.S. Pat. No. 2,147,502 to Savage provides a toss game wherein articles are pinched between a board and a peg and projected upwardly to be received within various coaxially aligned cups about a central support stand secured orthogonally to the game board.

U.S. Pat. No. 4,204,682 to Brown provides for a plurality of spaced receptacles positioned interiorly of a support surface wherein opposing players direct tossed rings at the receptacles to obtain a total point score.

U.S. Pat. No. 4,687,210 to Michael provides for a toy bouncing ring with a rebounding characteristic to impart an element of unpredictability in the rebounding of the article and providing a game developing an element of chance in predicting the rebounding characteristic of the article and attempting to catch such article in a rebounding procedure.

As such, it may be appreciated that there is a continuing need for a new and improved ring toss game wherein the same enables various elements of varying complexity to be cumulatively imparted to the game to enhance the play of the game and addresses the problems of entertainment and ease of use of the organization.

SUMMARY OF THE INVENTION

In view of the foregoing disadvantages inherent in the known types of ring toss game apparatus now present in the prior art, the present invention provides a ring toss game apparatus wherein the same utilizes a removable central target positioned within a receptacle and various articles positioned within the container to provide a target for rings tossed at the receptacle. As such, the general purpose of the present invention, which will be described subsequently in greater detail, is to provide a new and improved ring toss game apparatus which has all the advantages of the prior art ring toss game apparatus and none of the disadvantages.

To attain this, the present invention comprises a plurality of receptacle cases securable together for ease of transport and easily separable for spaced positioning relative to one another. Arcuate slots diametrically opposed to one another are positioned medially of the floor of each receptacle with optional pegs positioned coaxially of each container to provide varying levels of complexity for receiving ring-like washers tossed by opposing players at each game. The object of the game is to secure a ring-like element about a central peg member with the greatest points awarded for such accomplishment. An arbitrary designation of points are awarded for directing of a washer within the container and yet less points awarded for positioning a washer exteriorly of the cylindrical container but interiorly of the receptacle. Fewer points still are awarded based on the positioning of a washer proximate the receptacle.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ring toss game apparatus which has all the advantages of the prior art ring toss game apparatus and none of the disadvantages.

It is another object of the present invention to provide a new and improved ring toss game apparatus which may be easily and efficiently manufactured and marketed.

It is a further object of the present invention to provide a new and improved ring toss game apparatus which is of a durable and reliable construction.

An even further object of the present invention is to provide a new and improved ring toss game apparatus which is susceptible of a low cost of manufacture with regard to both materials and labor, and which accordingly is then susceptible of low prices of sale to the consuming public, thereby making such ring toss game apparatus economically available to the buying public.

Still yet another object of the present invention is to provide a new and improved ring toss game apparatus which provides in the apparatuses and methods of the prior art some of the advantages thereof, while simultaneously overcoming some of the disadvantages normally associated therewith.

Still another object of the present invention is to provide a new and improved ring toss game apparatus wherein the same enables varying levels of difficulty to be imparted to the game during its playing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an isometric illustration of a peg-like member positionable within a modified form of the instant invention.

DESCRIPTION OF THE PREFERRED EMBODIMENT

Figures 1, 2:
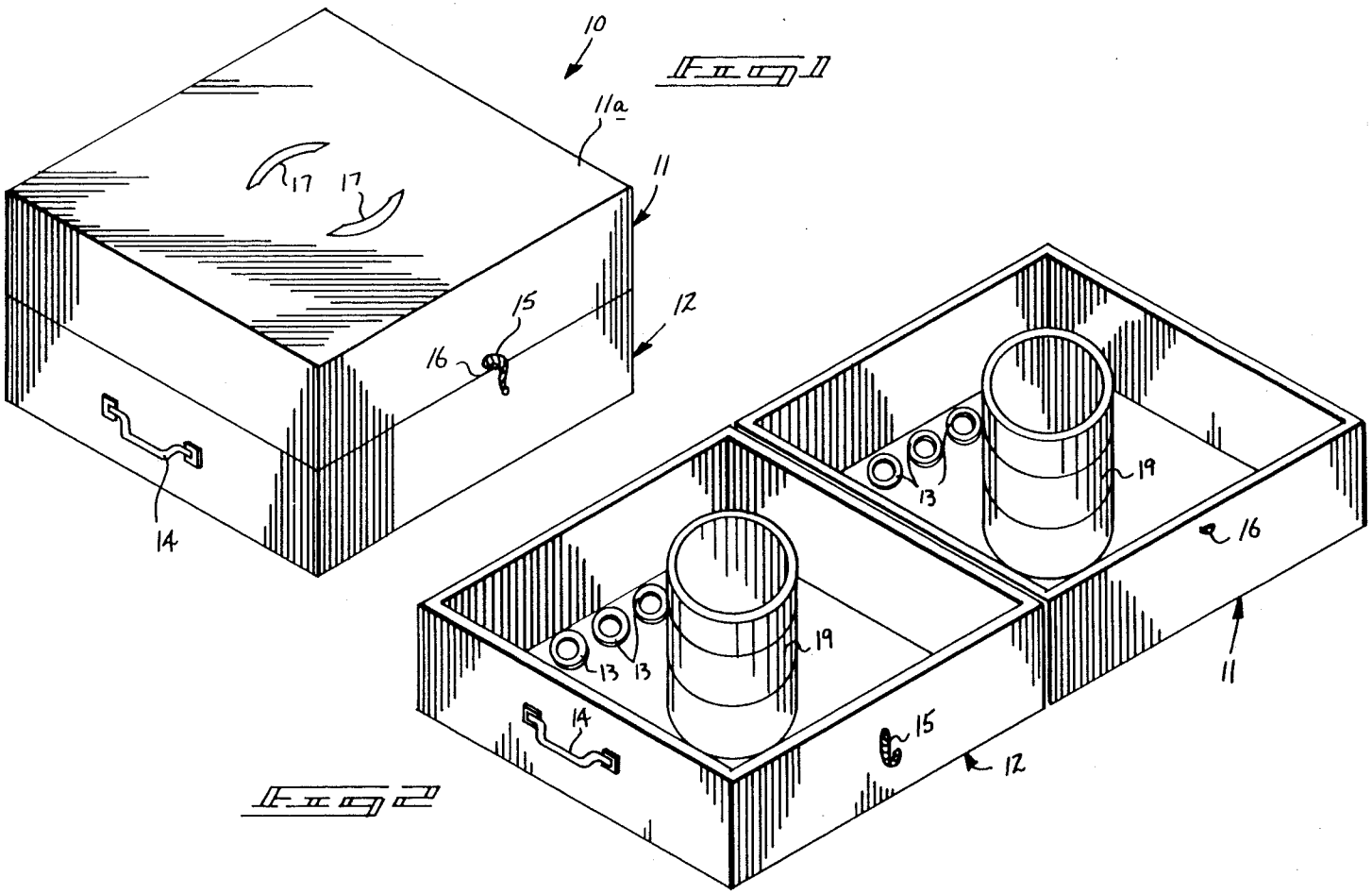
FIG. 1 is an isometric illustration of the instant invention in a secured orientation.
FIG. 2 is an isometric illustration of the instant invention in a separated configuration with cylindrical targets positioned therein.

With reference now to the drawings, and in particular to FIGS. 1 to 9 thereof, a new and improved ring toss game apparatus embodying the principles and concepts of the present invention and generally designated by the reference numeral 10 will be described.

Figure 3:
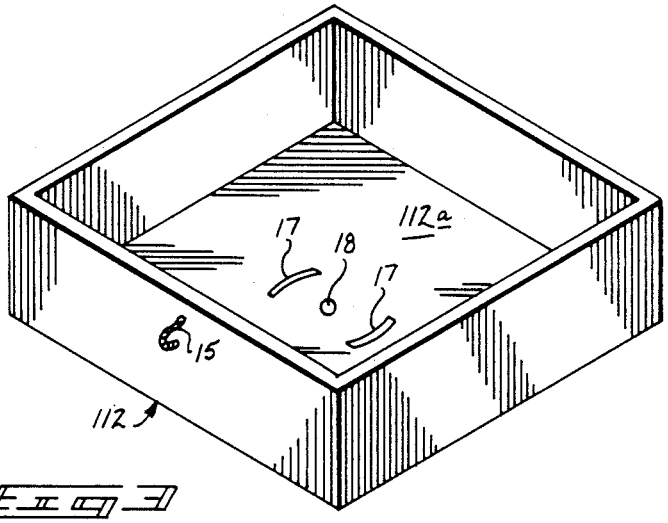
FIG. 3 is an isometric illustration of a single receptacle portion of the instant invention.
Figure 4:
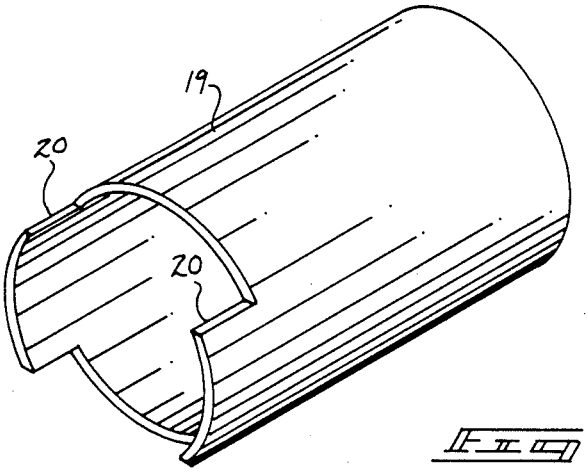
FIG. 4 is an isometric illustration of a single cylinder target of the instant invention.
Figure 5:
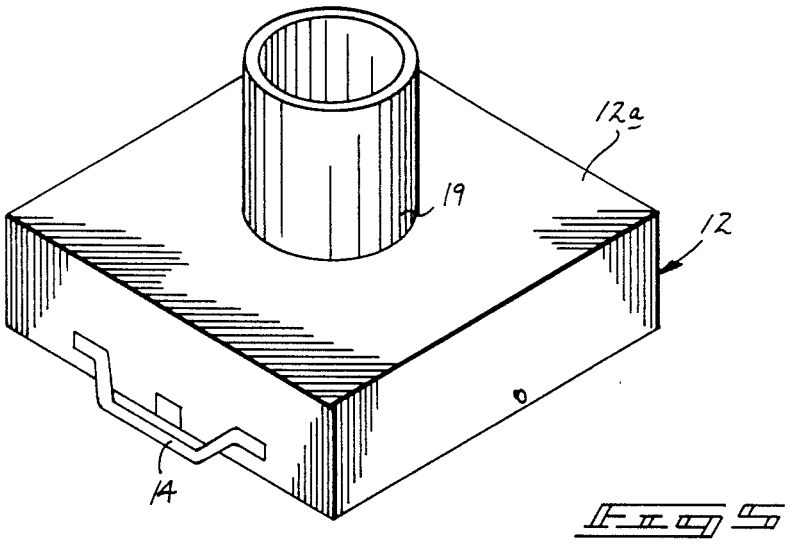
FIG. 5 is an isometric illustration of a cylinder target positioned upon an exterior surface of a receptacle.

More specifically, the ring toss game apparatus 10 of the instant invention essentially comprises a portable case organization comprising a first case 11 and a second case 12 of equal parallelepiped cross-sectional configuration. Each respective case 11 and 12 includes a respective first end wall 11*a* and a second end wall 12*a* with perimeter side walls directed orthogonally and continuously and forwardly of each of the respective end walls to define a receptacle by the respective cases 11 and 12. Each of the cases includes a series of planar ring washers 13 for tossing at an opposing receptacle target area. The second case 12 includes a handle 14 secured medially of one of the side walls with pivotally mounted clips 15 arranged on exterior surfaces of opposing side walls orthogonally oriented relative to the side wall receiving the handle 14. The pivotally mounted clips 15 cooperate with peg 16 mounted orthogonally outwardly of side walls of the first case 11 to enable securement of the case together, as illustrated in FIG. 1, for ease of portability of the organization. Each of the end walls 11*a* and 12*a* is formed with diametrically opposed slots 17 formed through-extending and medially of each of the end walls. FIG. 3 is illustrative of an embodiment of the instant invention utilizing an aperture 18 through-extending and coaxially of the slots 17 for reception of pegs, as will be discussed below. The diametrically opposed slots 17 are of a finite equal length and are positioned for reception of arcuate projections 20 of complementary cross-sectional configuration to that of the slots 17 to securely receive the projections therewithin. The arcuate projections 20 are integrally formed and extend from a lowermost edge of a target cylinder 19, as illustrated in FIG. 4. The target cylinder 19 may be positioned within each receptacle defined by the first and second cases 11 and 12 interiorly thereof directed upwardly from a floor of each receptacle defined by the end walls 11*a* and 12*a*. Alternatively, as illustrated in FIG. 5, the cylinder 19 may be secured to the end wall 11*a* exteriorly thereof and directed through an exterior surface of the associated end wall 12*a* where it is understood that the mirror image case may receive a similar cylinder through an end wall 11*a* exteriorly of the case.

Figure 6:
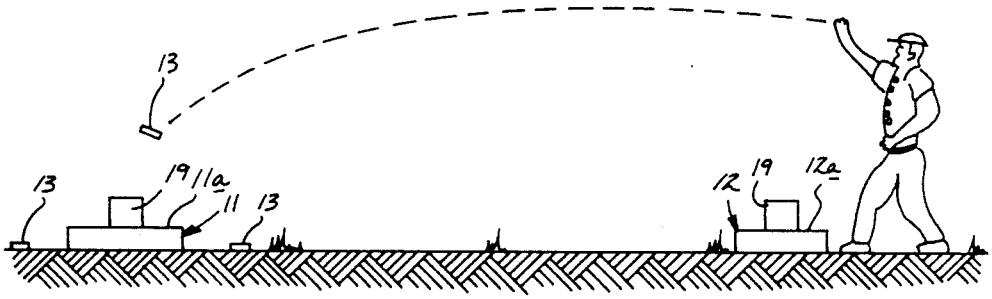
FIG. 6 is an orthographic view taken in elevation of the instant invention in use.

FIG. 6 is illustrative of the cases 11 and 12 utilized with the target cylinders positioned on exterior surfaces of the end walls 11*a* and 12*a*, wherein the cases 11 and 12 are positioned a fixed distance apart with rings 13 directed and targeted with the interior cavity of each of the respective cylinders 19 by opposing players.

Figure 9:
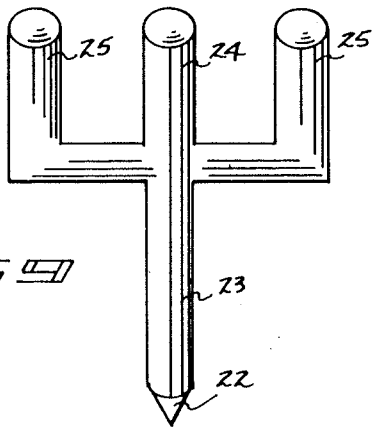
FIG. 9 is an isometric illustration of a modified peg for use in the invention as illustrated in FIG. 8.
Figure 11:
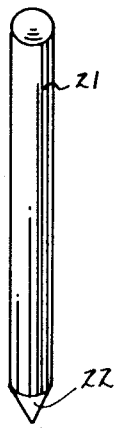
Figure 8:
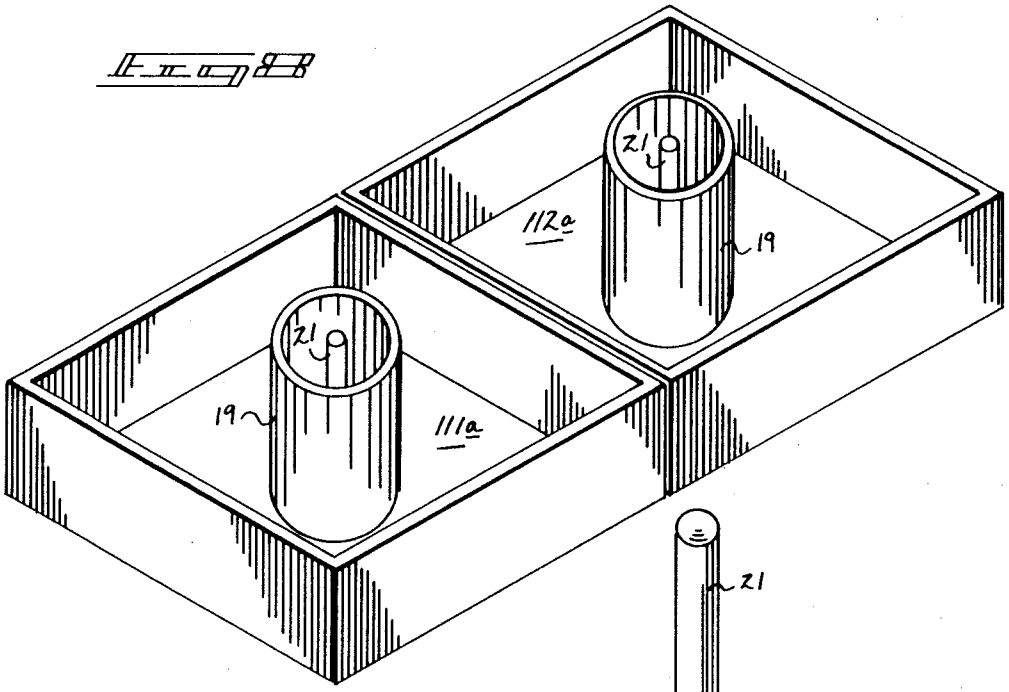
FIG. 8 is an isometric illustration of the instant invention utilizing a peg coaxially positioned within a target cylinder.

FIGS. 7 through 9 set forth a further use of the invention wherein the central aperture 18 coaxially aligned between the arcuate slots 17 receive a peg formed with a lower pointed end 22 that enables the peg to be driven through the through-extending aperture 18 into an underlying ground surface to securely anchor each receptacle. FIG. 7 illustrates a cylindrical peg 21, wherein FIG. 9 illustrates a forked peg utilizing a central cylindrical support with an inner central cylindrical peg 24 coaxially aligned with the cylindrical support 23 with outer pegs 25 formed concentrically about the central peg 24, wherein the pegs are each of an equal height.

It is understood that the object of the game is to direct the ring washers interiorly of a respective and opposed target cylinder 19. When the pegs 21 and 23 are utilized, the pegs are of a diameter less than the inner aperture diameter defined by each of the ring washers 13 to enable reception of the ring washers onto the pegs 21, 24, and 25. Ring washers directed about any of the pegs are awarded the greatest number of points wherein lesser points are awarded to washers received within a target cylinder onto an upstanding peg member. Yet lesser points are awarded for positioning of a ring washer interiorly of a respective case 11 and 12, with yet fewer points awarded depending on point positioning of the ring washer relative to the case wherein the closer the ring washer is to a case, the more points may be awarded. Such points may be awarded arbitrarily with an example providing a ring washer directed onto a peg member 21, 24, or 25 to be ten points, while a washer directed interiorly of the target cylinder 19 be of five points, with a ring washer directed interiorly of a case but not within a cylinder of two points, while a washer closest to the case be awarded one point. Washers directed at further distances may be awarded lesser points, such as one-half, one-quarter, etc.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ring toss game apparatus comprising, in combination, a first receptacle case and a second receptacle case, wherein each of the first and second receptacle cases are of equal cross-sectional configuration, and the first receptacle case including a first planar end wall and the second receptacle case including a second planar end wall, and first side walls extending in a surrounding relationship about the first end wall, and second side walls extending in a surrounding relationship about the second end wall, and plural securement means cooperatively mounted to the first and second side walls for selective securement of the first case and the second case together, and first securement apertures formed in the first end wall, and second securement apertures formed in the second end wall, and a first target means for securement to the first securement apertures, and a second target member for securement to the second securement apertures, and a first and second plurality of planar ring washers associated with each of said respective first and second cases for being tossed at an opposing second and first target means respectively by an individual, and including a handle mounted to a side wall of the first receptacle case, and wherein the first securement apertures comprise diametrically opposed and concentrically oriented arcuate slots positioned medially of the first end wall, and the second apertures comprise diametrically opposed and concentrically oriented arcuate slots formed medially of the second end wall, and wherein each first and second target member includes a hollow cylindrical member including arcuate projections of a predetermined cross-sectional configuration equal to a further cross-sectional configuration defined by each of the first and second arcuate slots, and the arcuate projections are integrally formed to a respective end of each of the cylindrical target members.

2. A ring toss game apparatus as set forth in claim 1 wherein the first and second securement apertures further comprise a through-extending circular aperture diametrically positioned between each of the respective first and second arcuate slots.

3. A ring toss game apparatus as set forth in claim 2 further including a cylindrical peg receivable in a respective circular aperture.

4. A ring toss game apparatus as set forth in claim 3 wherein the cylindrical peg further includes a central peg coaxially aligned with the central peg and further including a plurality of coaxially aligned outer cylindrical pegs of an equal height defined by the central cylindrical peg, and each of the cylindrical pegs define a predetermined circular cross-sectional area.

5. A ring toss game apparatus as set forth in claim 4 wherein each of the planar ring washers define a central aperture of a central aperture area equal to or greater than the predetermined circular area defined by each peg.

* * * * *